US008409486B2

(12) United States Patent
Sutter et al.

(10) Patent No.: US 8,409,486 B2
(45) Date of Patent: Apr. 2, 2013

(54) METHOD FOR MAKING STRUCTURAL PARTS WITH REINFORCEMENT FIBERES EMBEDDED IN A MATRIX MATERIAL USING THERMOPLASTIC FIBERS CONTAINING POLYHYDROXYETHER

(75) Inventors: Simon Sutter, Chur (CH); Jürgen Spindler, Domat/Ems (CH)

(73) Assignee: EMS-Chemie AG, Domat/EMS (CH)

( * ) Notice: Subject to any disclaimer, the term of this patent is extended or adjusted under 35 U.S.C. 154(b) by 88 days.

(21) Appl. No.: 13/210,091

(22) Filed: Aug. 15, 2011

(65) Prior Publication Data

US 2011/0298152 A1 Dec. 8, 2011

Related U.S. Application Data

(62) Division of application No. 11/378,630, filed on Mar. 20, 2006, now abandoned.

(30) Foreign Application Priority Data

Mar. 22, 2005 (EP) ..... 05006232

(51) Int. Cl.

| | |
|---|---|
| ***B29C 45/14*** | (2006.01) |
| ***B29C 70/10*** | (2006.01) |
| ***B32B 37/00*** | (2006.01) |
| *D03D 15/00* | (2006.01) |

(52) U.S. Cl. ..... 264/257; 264/279; 264/328.1; 442/301

(58) Field of Classification Search ..... None
See application file for complete search history.

(56) References Cited

U.S. PATENT DOCUMENTS

| | | | | |
|---|---|---|---|---|
| 2,602,075 | A | 7/1952 | Carpenter et al. | 528/95 |
| 3,234,313 | A | 2/1966 | Cook et al. | 264/230 |
| 3,305,528 | A | 2/1967 | Wynstra et al. | 528/95 |
| 3,356,646 | A | 12/1967 | Wynstra et al. | 528/88 |
| 3,375,297 | A | 3/1968 | Barth et al. | |
| 3,379,684 | A * | 4/1968 | Wiesner et al. | 528/93 |
| 3,395,128 | A | 7/1968 | Hale et al. | 528/367 |
| 3,405,199 | A | 10/1968 | Snedeker | |
| 3,480,695 | A * | 11/1969 | Hale | 525/462 |
| 4,657,954 | A | 4/1987 | Watanabe et al. | 523/459 |
| 5,286,553 | A * | 2/1994 | Haraguchi et al. | 442/199 |
| 5,506,300 | A | 4/1996 | Ward et al. | 525/88 |
| 5,814,705 | A | 9/1998 | Ward et al. | 525/88 |
| 6,054,215 | A | 4/2000 | Son et al. | |
| 6,872,273 | B2 * | 3/2005 | Davies et al. | 156/148 |
| 6,881,288 | B2 * | 4/2005 | Davies et al. | 156/148 |
| 7,276,132 | B2 * | 10/2007 | Davies et al. | 156/148 |

* cited by examiner

*Primary Examiner* — Christina Johnson
*Assistant Examiner* — Benjamin Schiffman
(74) *Attorney, Agent, or Firm* — Morgan, Lewis & Bockius LLP

(57) ABSTRACT

The invention describes a new synthetic fiber material of polyhydroxyether, as well as a melt-spinning method for its production. The new material can be used, in particular, for stabilization of the reinforcement fibers of high-performance fiber composite materials before they are embedded in the matrix material. During this usage, the polyhydroxyether fiber material dissolves at a temperature above its glass transition temperature entirely in the matrix material, so that the reinforcement fibers can be arranged largely free of kinking. In addition, it forms cross-links with the matrix material to form a homogeneous matrix and thus does not constitute a disruptive third phase in the composite material. The compatibility of the matrix and reinforcement fiber is also improved. It was possible to improve the bending strength of test slabs by 12% as compared to that of reference slabs with polyester filament.

20 Claims, No Drawings

METHOD FOR MAKING STRUCTURAL PARTS WITH REINFORCEMENT FIBERES EMBEDDED IN A MATRIX MATERIAL USING THERMOPLASTIC FIBERS CONTAINING POLYHYDROXYETHER

This application is a division of U.S. patent application Ser. No. 11/378,630, filed Mar. 20, 2006, now abandoned which claims priority to Swiss Patent Application No. EP 05006232.2, filed Mar. 22, 2005, all of which are hereby incorporated by reference in their entirety.

TECHNICAL FIELD

The present invention concerns a thermoplastic fiber material which is spun from a raw material containing a polyhydroxyether, methods for its production, and special uses for it.

PRIOR ART

Today, the melt-spinning method is preferably used to make synthetic fibers from polymers, because it is especially economical. Other spinning methods such as solution spinning are only used for polymers which cannot be spun from a melt.

Melt spinning requires the polymer being spun to be thermoplastic and sufficiently stable in the molten state under pressure and at the required extrusion temperature, that is, it neither breaks down nor builds up or becomes cross-linked. Polyhydroxyether is a thermoplastic polymer with excellent adhesion to many materials and because of this property it is eagerly used for a variety of applications. At elevated temperatures, however, it has a very poor stability which, according to U.S. Pat. No. 3,375,297, restricts or totally prevents its use in cases where resistance to elevated temperatures is a must. Consequently, difficulties should be expected in particular during melt spinning, since the extrusion temperature here must lie significantly above the softening temperature in other extrusion methods, due to the fine capillaries in the injector plate of the spinneret.

In U.S. Pat. No. 3,405,199, a flame-protected, shock-resistant formulation based on polyhydroxyether is described which is suitable for customary thermoplastic processing methods like extrusion. At one passage in the text, the possibility is mentioned of thermally forming polyhydroxyether into a useful contour, such as a film or a fiber. But it neither specifies more closely how this can be accomplished, nor what kind of special properties such a fiber will have, nor what such a fiber could be used for.

In the production of structural elements made from fiber composite materials with reinforcement fibers embedded in a matrix, one uses threads made from synthetic fibers, especially polyester threads (PET), as an auxiliary thread to stabilize the reinforcement fibers prior to being embedded in the matrix.

In unidirectional fabrics (so-called UDs), such as are often used to make structural parts from fiber composite materials, the auxiliary thread is used to fix the parallel lying reinforcement fibers in their parallel position and thus make the mat easy to handle as a cohesive whole.

In the so-called liquid molding (LM) method or the related methods such as resin transfer molding (RTM), vacuum assisted resin transfer molding (VARTM), resin film infusion (RFI) liquid resin infusion (LRI) and resin infusion flexible tooling (RIFT), the reinforcement fibers are joined together without matrix material into a preform and only then brought together with the matrix material, for example, in a form. In order for the preform to retain its shape during its construction, its handling, and the injection or infusion of the matrix material, the reinforcement fibers are stabilized, or fixed, to the auxiliary thread by embroidering, sewing or weaving techniques.

The auxiliary thread has various disadvantages in the finished part. For example, the reinforcement fibers are kinked at the points of intersection with the auxiliary thread, so that they are not ideally oriented in the direction of the primary force flow, which may result in a not insignificant weakening of the structural part. Also, its various physical properties, such as its different coefficient of thermal expansion, can weaken the structural part. Other drawbacks which may occur are shrinkage or a rough surface of the structural part.

An improvement is afforded by the use of GRILON® hotmelt yarns of the EMS Company with low melting point, ideally 60° C. or 85° C. These partly crystalline yarns melt as the matrix hardens and go partly or fully into solution, depending on the conditions, so that the reinforcement fibers can become better arranged in the structural part. The polymer material of the hotmelt yarn remains intact, however, as a third phase in the structural part, next to the reinforcement fiber and matrix. With its different physical properties, such as again a different coefficient of thermal expansion, it weakens the structural part.

To improve the adhesion between the matrix material and the reinforcement fibers in fiber composite materials, it is known how to pretreat the reinforcement fibers before being embedded in the matrix material with a so-called sizing agent to promote adhesion. Because of their already mentioned good adhesive properties, polyhydroxyethers have also already been used as such sizing agents, as is described in U.S. Pat. No. 6,020,063 or WO9101394A1, for example. In U.S. Pat. No. 6,020,063, moreover, the chemical structural formula of polyhydroxyether is given. Sizing agents of polyhydroxyether have good adhesion to the major reinforcement fibers, such as glass fibers and carbon fibers, and they are compatible with customary matrix systems based on epoxy, unsaturated polyester, cyanate ester, urethane, phenol, formaldehyde, melamine or combinations thereof. They are generally applied as aqueous polymer dispersions. They are not suitable for stabilization of the reinforcement fibers or a preform made from them prior to being embedded in the matrix.

PRESENTATION OF THE INVENTION

The present invention starts from the recognition that one can make a thermoplastic fiber material with an essentially amorphous structure in economical manner from polyhydroxyether, despite its poor stability to elevated temperatures, even by melt spinning, and this can be used with special advantage for the stabilizing of the reinforcement fibers or a preform made from them before being embedded in the matrix of fiber composite materials.

In this application, the polyhydroxyether fiber material dissolves completely in the matrix material at a temperature above its glass transition temperature, which eliminates, for example, the kinking problem with regard to the reinforcement fibers. In addition, however, it forms cross-links with the matrix material as it hardens into a homogeneous matrix. The cross-linking occurs by virtue of and at the multiple repeating OH groups along the chain of the molecule. In this way, the polyhydroxyether fiber material is integrated into the matrix and can no longer negatively affect the mechanical properties of the structural part. As a result, one gets a composite material that consists of only the two phases, namely, reinforcement fiber and matrix. The problem of incompatibility of matrix and auxiliary thread or auxiliary thread material is eliminated.

Since the chemical properties of the aforementioned sizing agents and of the polyhydroxyether fiber material according to the invention are essentially identical, neither does the use of the material according to the invention disturb the compatibility of the matrix and reinforcement fiber, but instead improves it further.

According to a first aspect of the invention, the object of the present invention is a thermoplastic fiber material, spun from a raw material containing polyhydroxyether, wherein the raw material contains polyhydroxyether as a single polymer, and the polyhydroxyether has an essentially amorphous structure, a molecular weight Mw of 10,000 to 80,000 Dalton, and a glass transition temperature $T_g$ of at most 100° C.

Molecular weight Mw refers to the mean molecular weight. Preferably, this value is 20,000 to 60,000 Dalton, especially 30,000 to 55,000 Dalton. These polymers are thermoplastic and linear, unlike the chemically related epoxy, which is of great significance to the fiber spinning. Under suitable cooling conditions, they solidify entirely amorphously. This is beneficial in the aforesaid use to stabilize the reinforcement fibers (or a preform made from them) before being embedded in the matrix of fiber composite materials, because they can thus be dissolved more easily. Their glass transition temperature $T_g$ (DSC) is typically between 84° and 98° C. and preferably below 95° C. and especially preferably below 90° C.

For composite applications of the kind to be described hereafter, however, with low hardening temperature of 60 to 90° C., one can use a polyhydroxyether in which the glass transition temperature $T_g$ has been reduced with short, grafted polycaprolactone side chains (e.g., InChemRez® PKCP-90 to around a value between 30 and 80° C., so that it lies a few degrees below the hardening temperature. A reduction of the glass transition temperature $T_g$ can also be achieved by adding a softener.

So that it can be processed or reprocessed by the conventional textile methods and used for the already mentioned and yet to be described application without problems, it should have a breaking strength greater than 5 cN/tex, preferably greater than 7 cN/tex, and especially preferably greater than 9 cN/tex.

The fiber material according to the invention can be a monofilament or contain such a monofilament, e.g., with a titer of 20-12,000 dtex, preferably 100-3000 dtex, and especially preferably 200-1500 dtex.

The fiber material according to the invention can be a multifilament or a multifilament yarn with a plurality of single filaments, or contain such, e.g., with an overall titer of 20-5000 dtex, preferably 100-1500 dtex. The number of single filaments is, for example, 10-120, preferably 20-50. The fiber material according to the invention can also be a staple fiber or contain such and it can be processed by conventional spinning methods, for example, into ring yarn, compact yarn, rotor yarn or carded yarn.

Two-dimensional textile forms can be made from the fiber material according to the invention, such as woven, knitted, fleece, felt, mats or the like.

According to a second aspect of the invention, the object of the present invention is a melt spinning method for production of a thermoplastic fiber material according to the already described first aspect of the invention. A special technique provides for the already mentioned low stability of polyhydroxyether to elevated temperatures. The melt spinning method of the invention therefore has the following features:

- the temperature of the polyhydroxyether in the melt is 160-300° C., preferably 180-280° C. and especially preferred 190-240° C.;
- the pressure of the polyhydroxyether in the melt is 50-100 bar;
- the dwell time of the polyhydroxyether in the melt is less than 15 minutes, preferably less than 10 minutes and especially preferably less than 8 minutes;
- the cooling of the thread is organized effectively and adapted to the spinning temperature.

By an effective and adapted cooldown is meant, in particular:

- a sufficient separation of the individual filaments by use of a injector plate with a capillary density less than 0.25 holes/cm2;
- the melt-spun material is cooled by blowing with air, and the blown air is first cooled to 10-20° C.;
- the melt-spun material is cooled by blowing with air, and the consumption of blown air is 200-300 $m^3$/kg, when high spinning temperatures of at least 240° C. are used, and less than 200 $m^3$/kg when lower spinning temperatures of less than 240° C. are used;
- the convergence length is 4-6 m.

The unit $m^3$/kg for the consumption of blown air means that this is the specific consumption of blown air relative to the polymer throughput, i.e., the ratio of the volume flow of blown air (in cubic meters of blown air per unit of time) to the polymer mass flow (in kg per the same unit of time), which goes through the spinning machine and is produced in the form of polymer thread.

Preferred embodiments of the method according to the invention are characterized by one or more of the following features:

- one uses a injector plate with 10-100 capillaries, preferably 20-50 capillaries;
- an injector plate is used with capillaries having diameter of 0.35-0.80 mm, preferably 0.40-0.60 mm;
- the melt-spun material is drawn off at a speed between 800 and 1800 m/min, preferably between 1200 and 1600 m/min;
- the melt-spun material is after-stretched by a factor of 1.1-1.8 to reduce the strain at fracture to below 150%, preferably below 100% and especially preferably below 80%;
- the melt-spun material is wound at a speed of 1000-3000, preferably 1500-2500 m/min.

At rather low spinning temperatures of below 240° C., a reduced quantity of blown air in the range of 10 to 200 $m^3$/kg is sufficient. Even less may suffice, i.e., when the other conditions are already satisfactory, one can even abandon any active blowing. In the latter case, the spinning threads are simply cooled passively by the surrounding room air on the convergence stretch, i.e., on the way between the exit from the injector plate and the first thread feed element.

The melt spinning method of the invention, moreover, can be a method for spinning of cables with subsequent stretching and cutting into staple fibers, a method with single-stage spinning stretching of staple fibers, a bulk continuous filament spinning (BCF), a filament spinning of partially oriented yarn (POY) or fully drawn yarn (FDY), an electrospinning of microfibers or a method with spinning of monofilaments in air or in a water bath.

The fact that only a melt spinning method is indicated above as being an aspect of the invention does not mean that the thermoplastic fiber material according to the invention can only be produced by melt spinning. However, the indicated melt spinning method is preferred on account of its economy.

According to a third aspect of the invention, an object of the present invention is the use of a thermoplastic fiber material as defined above according to the invention in the production of structural parts made from fiber composite materials with reinforcement fibers embedded in a matrix in order to secure the reinforcement fibers in a defined geometrical arrangement before they are embedded in the matrix.

In so doing, the reinforcement fibers can be secured with a thread made from thermoplastic fiber material, particularly by means of embroidery, sewing and/or weaving techniques.

The reinforcement fibers can also be secured with two-dimensional textile shapes made from the thermoplastic fiber material, in that such a two-dimensional shape especially in the form of a so-called nonwoven made from staple fibers is inserted, e.g., between the layers of a multiaxial matting of reinforcement fibers. Since the polyhydroxyether material becomes sticky and viscous under heat, the reinforcement fiber layers can be joined together by application of heat and possibly pressure.

Another way of making a stabilized preform is to press and mold a two-dimensional shape, such as a tissue or a mat consisting of a mixture of reinforcement fibers and polyhydroxyether fiber material according to the invention in a hot press above the softening temperature of the polyhydroxyether fiber material. The polyhydroxyether fiber material melts and serves as a hotmelt adhesive, which stabilizes and holds the preform together after the cooling and solidification. The polyhydroxyether hotmelt adhesive remains mechanically stable during the injection of the matrix material and only dissolves into the matrix material upon its hardening and forms cross-links with the matrix material to produce a homogeneous matrix.

The fiber material of the invention can be used especially well with reinforcement fibers made of glass, carbon, aramide, polybenzoxazole, polybenzimidazole and/or another of the so-called "rigid rod" polymers, and also with matrix materials consisting of cross-linkable resin system such as epoxy resin, unsaturated polyester resin, isocyanate ester resin, phenol resin, phenol-formaldehyde resin, melamine resin, or a combination of these resins. The matrix in the composite structural part can also consist entirely of polyhydroxyether.

When using a matrix of a cross-linkable resin system, it is preferable for this to contain at least one of the following cross-linking components:

- a polyisocyanate;
- a carboxylic acid;
- an anhydride, especially a cyclical anhydride;
- a phenol resin, especially a butylated phenol resin;
- a melamine resin, especially a methylated melamine resin;
- a cyclical oxide resin and catalytic quantities of a strong acid.

During the hardening of the resin system, the temperature should be higher than the glass transition temperature $T_g$ of the polyhydroxyether used in the fiber material according to the invention, so that the fiber material according to the invention dissolves in the matrix and forms cross-links with it.

WAYS OF IMPLEMENTING THE INVENTION

The polyhydroxyether fiber material according to the invention is preferably made by melt spinning. Especially preferred is a spinning-stretching method.

For the examples described hereafter, a spinning-stretching machine with cooling by cross-current blowing and subsequent winding, developed and built by EMS-CHEMIE AG, was used.

EXAMPLE 1

The raw material was a conventional polyhydroxyether, as is marketed, for example, by the firm InChem under the brand InChemRez® PKHH Phenoxy Resin, with a molecular weight Mw of 52,000 Dalton. Its glass transition temperature $T_g$ (DSC) was 92° C. It would likewise be possible to use an InChemRez® grade with higher or lower molecular weight or a similar raw material from another manufacturer.

The polyhydroxyether polymer was fed to the spinning machine in the form of pellets. If necessary, heat and UV stabilizers or other additives could also be added in this phase by using a volumetric or preferably a gravimetric dispenser.

The pellets were first dried to a residual moisture content of less than 0.01% $H_2O$, in order to prevent the formation of water vapor bubbles in the melt. In the spun filaments, such bubbles result in defect sites where a tearing can occur under the least mechanical stress. For gentle treatment of the raw material, a vacuum tumbling dryer was used for the drying. The drying was done for 15 hours at 80° C.

In the present case, however, even very good preliminary drying cannot totally prevent a formation of bubbles in the melt. Due to the limited thermal stability of the polyhydroxyether polymer, additional water vapor is produced in the melt by splitting off of hydroxyl groups. This unwanted effect can be counteracted by a short dwell time and/or low temperature in the melt.

It has been discovered that the formation of bubbles at melt dwell time of more than 15 minutes is so intense that a continuous draw-off of the filament is virtually impossible, because the still molten filaments become torn at weak sites with too large or too many bubbles. Therefore, the dwell time should be less than 15 minutes. Preferably, the dwell time is less than 10 minutes and especially preferably less than 8 minutes.

To achieve such short dwell time, the spinning machine and the spinning parameters were suitably designing them to comprise, among other things, only one extruder per spinneret and thus a relatively short melt feed line, as well as a volume-optimized spinneret.

The extruder and spinning head temperature should be adapted to the melt viscosity, or the molecular weight of the polymer, so that the material is adequately stretchable and no brittle fracture occurs immediately after the spinning head, where the spinning draft is large. For InChemRez® PKHH, this is around 100° above its initial flow temperature, i.e., 240 to 300° C., preferably 260 to 280° C.

The nozzle plate had capillaries with a diameter of 0.5 mm, but diameters of 0.35 to 0.80 mm would also be possible. This produced a nozzle pressure of around 50 to 100 bar, guaranteeing a uniform distribution of the melt among all capillaries (nozzle perforations).

As a result of the pressure loss occurring when the melt emerges from the capillaries, the aforementioned gas bubbles present in the melt have a tendency to expand or even to form new bubbles. In order to curb bubble formation in this phase as well, an intensive cooling was provided for the freshly spun single filaments emerging from the capillaries. Thanks to the intense cooling, the viscosity of the melt increases so fast that the bubbles have little time to form and/or expand. (On the other hand, if spinning with lower melt temperature, the requirements on the subsequent cooling are less.)

The injector plate was provided with only 40 capillaries at a diameter of 180 mm. Thus, the capillary density was less than 0.25 holes/cm$^2$. It was also therefore around 10 times smaller than is usual during melt-spinning of polyester or polyamide, for example. By the same token, the mutual spacing of the single filaments emerging from the capillaries was relatively large and the thread/curtain formed by the single filaments was relatively quite transparent. This enabled an optimal passage of the blown air flow and, thus, a very effective cooling of the single filaments. In the present example (with high melt temperature), the blown air consumption was 200-300 m$^3$/kg. For a further optimization of the cooling, the blown air was additionally precooled to around 16° C. As mentioned, the cooling was cross-current. A central blowing would also be possible and perhaps even preferable.

The convergence length between injector plate and a preparation device in front of the first galette duo was around 5 m and thus somewhat larger than those used in the melt-spinning of conventional fiber polymers. Thus, the single filaments had relatively much time for cooling and to lose their stickiness.

In order to obtain a multifilament or multifilament yarn of 500 dtex with the 40 single filaments, the drawing was done at a throughput rate of 90 g/min per spinneret with 1200 m/min using galette duos, followed immediately by stretching to a factor of 1.5 at a winding speed of 1800 m/min.

The galette duos were heated in order to fix the multifilament yarn formed from the single filaments at temperatures between 80 and 120° C. after the stretching. A slight relaxation of 0 to 3% between galette duo 2 and galette duo 3 was able to further improve the fixation and largely prevent an unwanted shrinkage in the further processing.

The polyhydroxyether multifilament yarn produced in this way had the following properties:

| | | |
|---|---|---|
| Titer | tex | 50 |
| Number of single filaments | f | 40 |
| Breaking force | N | 5.5 |
| Breaking strength | cN/tex | 11 |
| Breaking strain | % | 41 |
| Breaking energy | N cm | 102 |
| Glass transition temperature | ° C. | 93 |

EXAMPLE 2

Another possibility is the use of a polyhydroxyether with lower molecular weight. We used InChemRez® PKHB+ with a molecular weight Mw of 32,000 Dalton.

The same spinning layout was used as in Example 1 and the procedure was the same. The lower melt viscosity enabled reduced spinning temperatures of 200 to 220° C., at which the material was always still stretchable enough below the spinneret. At this lower temperature level, it was possible to avoid the formation of gas bubbles in the melt. Thus, it was no longer necessary to have any intense blowing of the filaments.

But on the other hand, the lower extrusion temperature also required milder cooling conditions, so that the fresh fiber became stretchable, and therefore the cooling air flow was reduced to 10-50 m$^3$/kg.

A spinneret with 28 holes was used, i.e., the hole density was even less than in Example 1.

The draw-off speed was 1500 m/min and it was only possible to adjust a final stretching by a factor of 1.1-1.2. Before the winding, the filaments were air-swirled with a Heberlein Polyjet SP25 for better thread closure.

The polyhydroxyether multifilament yarn produced had the following properties:

| | | |
|---|---|---|
| Titer | tex | 50 |
| Number of single filaments | f | 28 |
| Breaking force | N | 4.7 |
| Breaking strength | cN/tex | 9.4 |
| Breaking strain | % | 38 |
| Glass transition temperature | ° C. | 85 |

Thanks to the lower molecular weight than Example 1, the yarn had a somewhat smaller breaking strength, but on the other hand the spinning process was more stable and the yarn had few broken filaments.

EXAMPLE 3

Using a pilot staple fiber layout developed and constructed by EMS-CHEMIE, 10 spools of Example 1 with this polyhydroxyether multifilament yarn were drawn off in parallel overhead and folded, air-extruded, and cut into staple fibers with a staple length of 80 mm.

Since this method is not economical for rather large volumes, spinning-stretching on an EMS-ESPE staple fiber layout is recommended.

The application properties of the polyhydroxyether fiber material were determined by testing as follows:

The dissolving behavior in epoxy resin (Araldite® PY 306 of Huntsman) was investigated with a heating stage microscope (Leitz DMRBE of Leica with FP 82 heating stage and FP 90 processor from Mettler Toledo). After 2 hours at isothermal 180° C., no more polyhydroxyether fibers were distinguishable.

The cross-linking was tested by an extraction test. For this, 10% of short cut polyhydroxyether fibers were dissolved in epoxy (Araldite® PY306 of Huntsman, Araldite® MY0510 of Huntsman, EPIKURE™ 3601 of Resolution Performance Products) and hardened. The cast slab was ground up under cooling with dry ice, and particles less than 60 microns were separated. As the reference, the slab was made without polyhydroxyether fibers and a slab was made with 10% polyester fibers (GRILENE® F3 6.7 dtex), prepared in the same fashion. The powder fractions >60 microns were extracted in m-cresol (Merck) for 2 hours at 95° C. under stirring. Under these conditions, the polyhydroxyether fiber material had completely dissolved.

After drying and reweighing of the powder fractions, the following weight losses were found:

| Sample | Weight Loss |
|---|---|
| Epoxy without fibers | 2.1% |
| Epoxy with 10% polyhydroxyether fibers | 2.8% |
| Epoxy with 10% polyester fibers | 10.7% |

The result shows that the bulk of the polyhydroxyether fiber material had reacted with the epoxy resin and was no longer soluble, unlike the polyester fiber, which was not able to form cross-linking.

The mechanical properties were tested on carbon fiber/epoxy composite material slabs. A UD fabric of 1200 mm width was prepared with a carbon fiber T-700S 6K from the Toray company. In the weft, a polyhydroxyether multifilament yarn 500 dtex f40 was woven in every 10 mm for fixation. As the reference, a sample with a commercially available polyester filament yarn Trevira® (330 dtex) was used, i.e., a more fine thread, which should present less of a disturbance on account of the thinner cross section.

Reference and sample slab were impregnated with epoxy resin (Araldite® PY306 from Huntsman, Araldite® MY0510 from Huntsman, EPIKURE™ 3601 from Resolution Performance Products). Five layers were placed one on top of the other at angles of 0°/+45°/90°/−45°/0° and hardened in a press (PSO press from OMS, IT) for 2.5 hours at 180° C.

The bending strength of the sample slab with polyhydroxyether fiber material according to the invention was improved by 12% as compared to the reference slab with polyester filament.

A contributing factor is that the use of the fiber material according to the invention, after dissolving and cross-linking with the matrix material, improves the adhesion of the reinforcement fiber and matrix in the composite material.

Embroidery tests were carried out for the tailored fiber placement TFP on an experimental tape application machine from Mountek/Tajima, Del. A polyhydroxyether multifilament yarn was first run up to 300 T/m Z in order to achieve better running properties in the needle. Because of its large cross section, a special needle had to be used. It was possible to work at speeds up to 500 rpm.

The invention claimed is:

1. A method for making structural parts with reinforcement fibers embedded in a matrix material consisting of a cross-linkable resin system, comprising the steps:

a) providing the reinforcement fibers and a thermoplastic fiber material;

b) securing the reinforcement fibers with the thermoplastic fiber material in a defined geometrical arrangement to form a preform, wherein the thermoplastic fiber material is spun from a raw material containing polyhydroxyether as a single polymer, and wherein the polyhydroxyether has an essential amorphous structure, a molecular weight Mw of 10,000 to 80,000 Dalton, and a glass transition temperature Tg of no more than 100° C.;

c) embedding the reinforcement fibers and the thermoplastic fiber material in the matrix material by injection of the matrix material into the preform; and d) hardening the cross-linkable resin system, causing the thermoplastic fiber material to dissolve in the matrix material.

2. The method of claim 1, wherein the reinforcement fibers are secured with a thread made from the thermoplastic fiber material by embroidery, sewing or weaving techniques.

3. The method of claim 1, wherein the reinforcement fibers are secured with a two-dimensional textile form made from the thermoplastic fiber material.

4. The method of claim 1, wherein the reinforcement fibers are secured by at least partly melting the thermoplastic fiber material at a temperature above its softening point.

5. The method of claim 1, wherein the cross-linkable resin system is hardened at a temperature higher than the glass transition temperature Tg of the polyhydroxyether used in the thermoplastic fiber material.

6. The method of claim 1, wherein the reinforcement fibers consist of glass, carbon, aramide, polybenzoxazole, polybenzimidazole and/or other so-called "rigid rod" polymers.

7. The method of claim 1, wherein the cross-linkable resin system is at least one of epoxy resin, unsaturated polyester resin, isocyanate ester resin, phenol resin, phenol-formaldehyde resin and melamine resin.

8. The method of claim 1, wherein the cross-linkable resin system contains at least one of the following cross-linking components: a polyisocyanate; a carboxylic acid; an anhydride, especially a cyclical anhydride; a phenol resin, especially a butylated phenol resin; a melamine resin, especially a methylated melamine resin; a cyclical oxide resin and catalytic quantities of a strong acid.

9. The method of claim 1, wherein the polyhydroxyether has a molecular weight Mw of 20,000 to 60,000 Dalton.

10. The method of claim 1, wherein the polyhydroxyether has a molecular weight Mw between 30,000 and 55,000 Dalton.

11. The method of claim 1, wherein the polyhydroxyether has a glass transition temperature Tg less than 95° C.

12. The method of claim 1, wherein the polyhydroxyether has a glass transition temperature Tg less than 90° C.

13. The method of claim 1, wherein the polyhydroxyether is chemically modified by grafting of short polycaprolactone side chains, in order to lowers its glass transition temperature Tg to a value between 30 and 80° C.

14. The method of claim 1, wherein the thermoplastic fiber material has a breaking strength greater than 5 cN/tex.

15. The method of claim 1, wherein the thermoplastic fiber material is or contains a monofilament with a titer of 100 to 3000 dtex.

16. The method of claim 1, wherein the thermoplastic fiber material is or contains a multifilament with a plurality of single filaments with an overall titer of 100 to 1000 dtex.

17. The method of claim 1, wherein the thermoplastic fiber material is or contains a multifilament with 10 to 120 single filaments.

18. The method of claim 1, wherein the thermoplastic fiber material is or contains a staple fiber.

19. The method of claim 1, wherein the thermoplastic fiber material is processed from staple fiber into ring yarn, compact yarn, rotor yarn or carded yarn.

20. The method of claim 1, wherein the thermoplastic fiber material is processed into a two-dimensional textile form, such as a woven or knitted form, a fleece, a felt, or a scrim.

* * * * *